US009123309B2

(12) United States Patent
Jeon

(10) Patent No.: US 9,123,309 B2
(45) Date of Patent: Sep. 1, 2015

(54) DISPLAY DEVICE USING BOOSTING-ON AND BOOSTING-OFF GATE DRIVING VOLTAGES

(75) Inventor: Jin Young Jeon, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 451 days.

(21) Appl. No.: 13/426,770

(22) Filed: Mar. 22, 2012

(65) Prior Publication Data

US 2013/0135282 A1 May 30, 2013

(30) Foreign Application Priority Data

Nov. 25, 2011 (KR) ..... 10-2011-0124354

(51) Int. Cl.
*G09G 3/36* (2006.01)

(52) U.S. Cl.
CPC ..... *G09G 3/3696* (2013.01); *G09G 2310/08* (2013.01); *G09G 2320/0219* (2013.01); *G09G 2320/0247* (2013.01); *G09G 2330/021* (2013.01)

(58) Field of Classification Search
CPC ..... G09G 3/36
USPC ..... 345/84–104, 204, 211, 212, 690
See application file for complete search history.

(56) References Cited

U.S. PATENT DOCUMENTS

| | | | | |
|---|---|---|---|---|
| 8,279,210 | B2 * | 10/2012 | Im et al. | 345/211 |
| 2007/0001955 | A1 * | 1/2007 | Lee | 345/89 |
| 2007/0121395 | A1 | 5/2007 | Kim et al. | |
| 2007/0262943 | A1 * | 11/2007 | Kang | 345/98 |
| 2008/0191992 | A1 * | 8/2008 | Joo | 345/99 |
| 2009/0174646 | A1 * | 7/2009 | Lim | 345/100 |
| 2010/0134401 | A1 * | 6/2010 | Shin et al. | 345/99 |

FOREIGN PATENT DOCUMENTS

| | | | |
|---|---|---|---|
| KR | 10-2007-0040172 | A | 4/2007 |
| KR | 10-2007-0054383 | A | 5/2007 |

* cited by examiner

*Primary Examiner* — Pegeman Karimi
(74) *Attorney, Agent, or Firm* — Lee & Morse, P.C.

(57) ABSTRACT

A display device, including a signal controlling unit, a data driving unit, a gate driving voltage generating unit, a gate driving unit, and a display panel. The display panel displays an image during a frame period including a blank period and a display period. The gate driving voltage generating unit receives a control signal and an analog driving voltage. The gate driving voltage generating unit generates boosting-on and boosting-off gate driving voltages based on the analog driving voltage. The gate driving voltage generating unit outputs the boosting-on gate driving voltage during a part of the frame period and the boosting-off gate driving voltage during a remaining of the frame period.

23 Claims, 7 Drawing Sheets

DISPLAY DEVICE USING BOOSTING-ON AND BOOSTING-OFF GATE DRIVING VOLTAGES

BACKGROUND

1. Field

Embodiments relate to a display device.

2. Description of the Related Art

A conventional display device has a plurality of pixel electrodes, a plurality of switching elements respectively connected to the plurality of pixel electrodes, a plurality of gate lines, and a plurality of data lines.

Various types of voltages or power supply voltages are required to drive a display device. To generate various voltages, the display device may have an AC/DC converter converting an input AC power supply voltage into a DC power supply voltage, an analog circuit converting the DC power supply voltage into an analog driving voltage AVDD, and the like. The analog driving voltage AVDD is generated by regulating a reference power supply voltage to a predetermined level using a regulator and boosting the regulated voltage using a booster circuit such as a charge pump.

A gate driving voltage generating unit generates a gate-on voltage and a gate-off voltage using the analog driving voltage AVDD. The gate-on voltage and the gate-off voltage can be generated by boosting the analog driving voltage AVDD using a booster circuit such as a charge pump. The gate-on voltage and the gate-off voltage are applied to a gate driving unit to be output to gate lines as a gate signal.

Although the gate signal is not output to the gate lines from the gate driving unit, a conventional gate driving voltage generating unit provides the gate driving unit with the boosted gate-on voltage and the boosted gate-off voltage.

A load of the gate driving unit is reduced during a period where no gate signal is output. Thus, at the gate driving unit, the gate-on voltage increases, and the gate-off voltage is lowered. Since the gate-on voltage and the gate-off voltage are varied largely, a long time is required until a gate signal output from the gate driving unit is stabilized. This may cause fluctuation and ripple of a gate signal. The fluctuation and ripple of the gate signal increases a flicker difference according to a location of a display panel.

If the boosted gate-on voltage and the boosted gate-off voltage are supplied to the gate driving unit regardless of whether the gate signal is output, power consumption of the display device increases.

SUMMARY

One or more embodiments provide a display device which includes a signal controlling unit, a data driving unit, a gate driving voltage generating unit, a gate driving unit, and a display panel.

One or more embodiment provide a display device, including a signal controlling unit configured to output a plurality of control signals and image data based on a vertical synchronization signal defining a frame period including a blank period and a display period, a horizontal synchronization signal, a clock signal, and a data enable signal, a data driving unit configured to receive the image data and to output a data signal converted from the image data during the display period, a gate driving voltage generating unit configured to receive a part of the control signals and an analog driving voltage, the gate driving voltage generating unit being configured to output a boosting-on gate driving voltage during a boosting-on period corresponding to a part of the frame period and a boosting-off gate driving voltage during a boosting-off period corresponding to a remainder of the frame period, a gate driving unit configured to output a gate signal during the display period in response to the boosting-on gate driving voltage, and a display panel configured to display an image in response to the gate signal and the data signal.

The gate driving voltage generating unit may include a boosting controlling unit configured to generate a boosting unit operating signal in response to the part of the control signals, and a boosting unit configured to receive the analog driving voltage and to output the boosting-on gate driving voltage and the boosting-off gate driving voltage in response to the boosting unit operating signal.

The boosting unit operating signal may have a first level during the boosting-on period and a second level different from the first level during the boosting-off period, and the boosting unit may be configured to output the boosting-on gate driving voltage and the boosting-off gate driving voltage according to a level of the boosting unit operating signal.

The boosting-on period may correspond to the display period.

The part of the control signals may be generated according to the data enable signal, the data enable signal may define the blank period and the display period, and the boosting controlling unit may be configured to invert a phase of the data enable signal and to generate the boosting unit operating signal having the first level and the second level.

The boosting-on period may include the display period and a part of the blank period.

The part of the control signals may be generated according to the vertical synchronization signal, the horizontal synchronization signal, and the clock signal, and the boosting controlling unit decides a first driving period of the boosting unit operating signal, having the first level, corresponding to the display period based on the vertical synchronization signal and the clock signal and a second driving period of the boosting unit operating signal, having the first level, corresponding to the part of the blank period based on the horizontal synchronization signal.

The blank period may include a first porch period corresponding to a period from a start point of the frame period to a start point of the display period, and a second porch period corresponding to a period from an end point of the display period to an end point of the frame period.

The boosting unit operating signal may include the second driving period having the first level and a non-driving period having the second level corresponding to the blank period, and the second driving period and the non-driving period are alternated during the blank period.

The boosting unit operating signal may include the second driving period having the first level and a non-driving period having the second level corresponding to the blank period, and the second driving period has a length corresponding to plural periods of the horizontal synchronization signal.

The boosting-on period may correspond to the display period.

The blank period may include a first porch period corresponding to a period from a start point of the frame period to a start point of the display period; and a second porch period corresponding to a period from an end point of the display period to an end point of the frame period.

The boosting-on period may include a first driving period corresponding to the display period and a second driving period corresponding to a part of the blank period.

The blank period may include a first porch period corresponding to a period from a start point of the frame period to a start point of the display period, and a second porch period corresponding to a period from an end point of the display period to an end point of the frame period.

The first porch period and the second porch period may include the second driving period, respectively.

The blank period may include the second driving period and a non-driving period, and the second driving period and the non-driving period of the blank period alternate.

A length of the second driving period may be substantially or completely equal to a length of the non-driving period.

The display panel may include a plurality of data lines, a plurality of gate lines isolated from the plurality of data lines and arranged to intersect with the plurality of data lines, and a plurality of pixels arranged at intersections of the plurality of data lines and the plurality of gate lines, respectively.

Each of the plurality of pixels may include a switching element configured to output the data signal in response to the gate signal, and a liquid crystal capacitor configured to receive the data signal and a common voltage having a voltage level different from the data signal.

One or more embodiments provide a display device, including a signal controlling unit configured to output image data, a gate driving unit configured to output a gate signal during a display period of a frame period including the display period and a blank period, a data driving unit configured to convert the image data into a data signal and to output the data signal during the display period, a gate driving voltage generating unit configured to receive an analog driving voltage and to output a boosting-on gate driving voltage, generated based on the analog driving voltage, to the gate driving unit during the display period and a boosting-off gate driving voltage, generated based on the analog driving voltage, to the gate driving unit during the blank period, and a display panel configured to display an image in response to the gate signal and the data signal.

BRIEF DESCRIPTION OF THE DRAWING

One or more features will become apparent to those of ordinary skill in the art by describing in detail exemplary embodiments with reference to the attached drawings in which.

DETAILED DESCRIPTION

Figure 1:
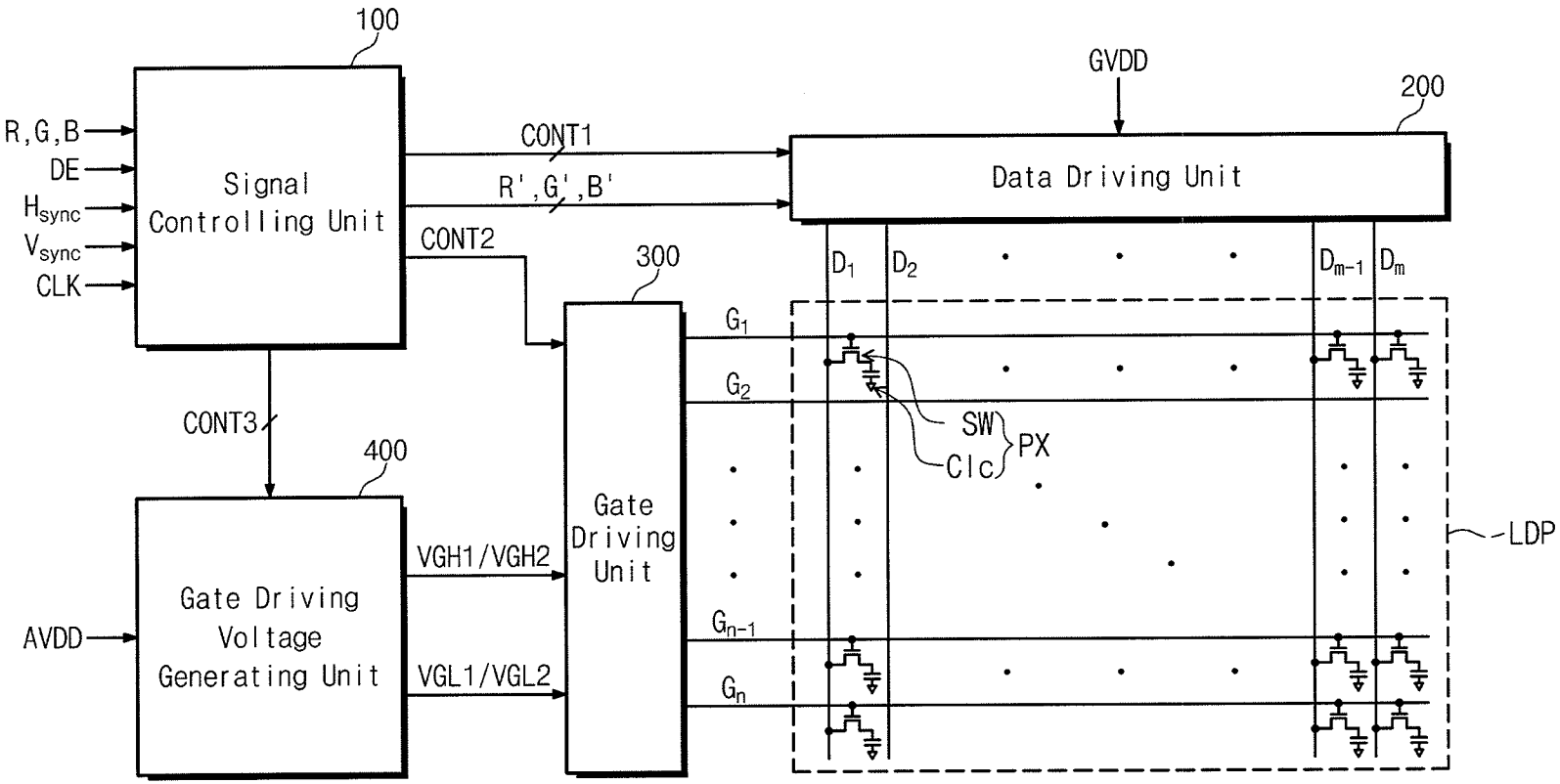
FIG. 1 illustrates a block diagram of a display device according to an exemplary embodiment.

Korean Patent Application No. 10-2011-0124354, filed on Nov. 25, 2011, in the Korean Intellectual Property Office, and entitled: "Display Device," is incorporated by reference herein in its entirety.

The inventive concept is described more fully hereinafter with reference to the accompanying drawings, in which embodiments of the inventive concept are shown. This inventive concept may, however, be embodied in many different forms and should not be construed as limited to the embodiments set forth herein. Rather, these embodiments are provided so that this disclosure will be thorough and complete, and will fully convey the scope of the inventive concept to those skilled in the art. In the drawings, the size and relative sizes of layers and regions may be exaggerated for clarity. Like numbers refer to like elements throughout the specification.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 2:
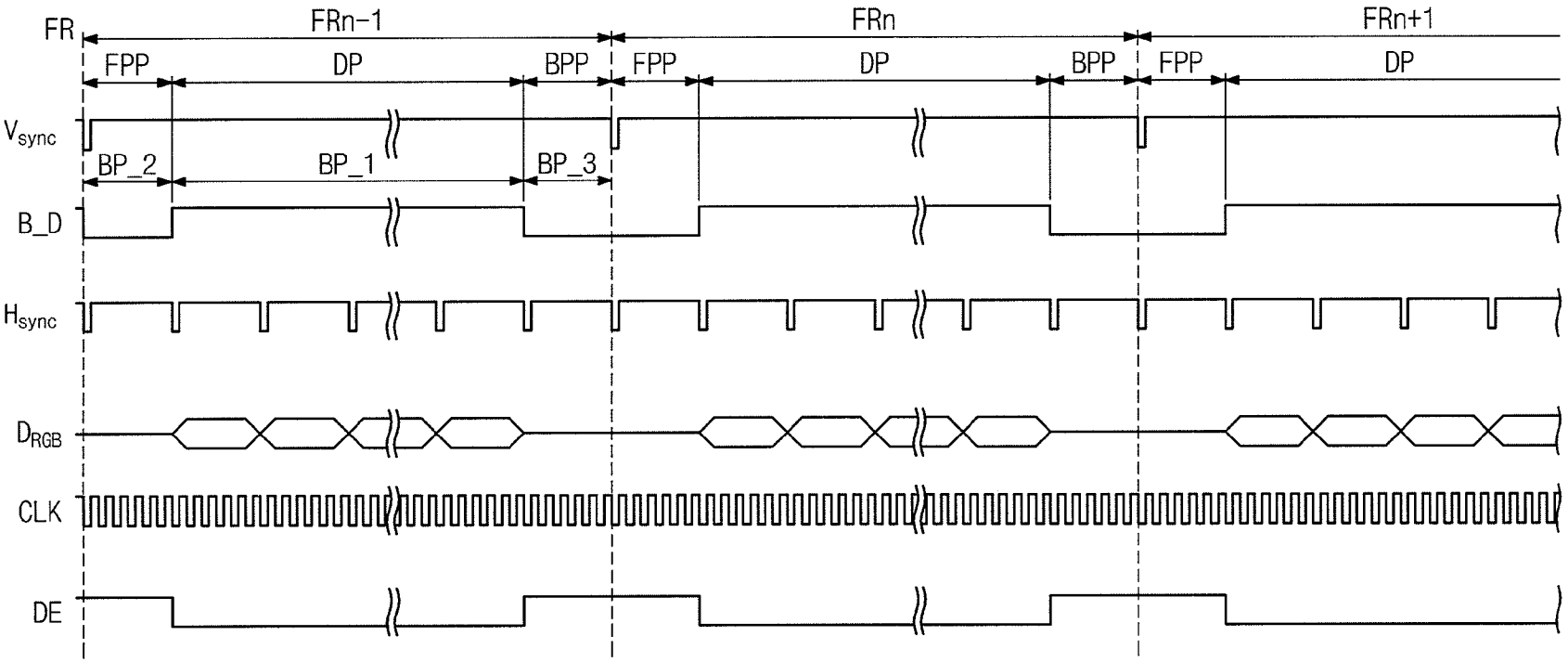
FIG. 2 illustrates a timing diagram of exemplary signals according to an exemplary embodiment.
Figure 3:
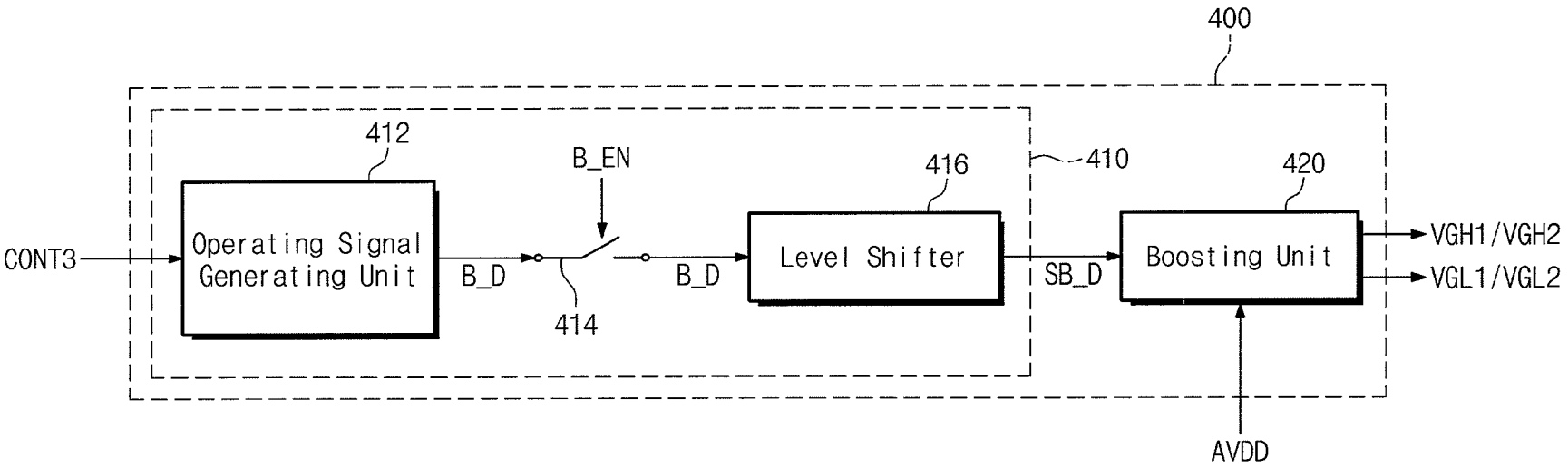
FIG. 3 illustrates a block diagram of a gate driving voltage generating unit illustrated in FIG. 1.

FIG. 1 illustrates a block diagram of an exemplary embodiment of a display device. FIG. 2 illustrates a timing diagram of exemplary signals employable for driving the display device of FIG. 1. FIG. 3 illustrates a block diagram of a gate driving voltage generating unit 400 illustrated in FIG. 1.

Referring to FIGS. 1 through 3, one or more embodiments of the display device may include a display panel LDP, a signal controlling unit 100, a data driving unit 200, a gate driving unit 300, and the gate driving voltage generating unit 400.

The display panel LDP displays images. The display panel LDP is not limited to a specific type of device. For example, the display panel LDP may include display panels such as a liquid crystal display panel, an organic light emitting display panel, an electrophoretic display panel, an electrowetting display panel, and the like may be used as the display panel LDP. FIG. 1 illustrates a liquid crystal display panel as an exemplary display panel LDP.

Referring to FIG. 1, the display panel LDP may include a plurality of gate lines G1 through Gn extending along a first direction and a plurality of data lines DL1 through Dm extending along a second direction intersecting the first direction and isolated from the plurality of gate lines G1 through Gn. The display panel LDP may include a plurality of pixels PX that are connected to the data lines DL1 through DLm and the gate lines G1 through Gm, respectively.

As illustrated in FIG. 1, each of the pixels PX may include a switching element SW that may output a data signal in response to a gate signal and a liquid crystal capacitor Clc that may receive the data signal. Each of the switching elements SW may be connected to a corresponding one of the data lines D1 through Dm and to a corresponding one of the gate lines G1 through Gn. The display panel LDP may include two substrates (not shown) opposite to each other and a liquid crystal layer (not shown) interposed between the two substrates.

The switching elements SW, the gate lines G1 through Gn, and the data lines D1 through Dm may be provided on one of the two substrates. Each of the switching elements SW may be a thin film transistor. The liquid crystal capacitor Clc may include a first electrode connected to the switching element SW, a second electrode opposite to the first electrode, and the liquid crystal layer. The second electrode may be provided at one of the two substrates and may receive a common voltage having a level different from the data signal. For example, the second electrode may be a common electrode provided at a substrate, on which the first electrode is not provided, from among the two substrates.

The signal controlling unit 100 may receive image signals R, G, and B and a control signal provided from an external graphic controller (not shown). The control signal may include a vertical synchronization signal Vsync, a horizontal synchronization signal Hsync, a clock signal CLK, and a data enable signal DE, and the like, for example. The signal controlling unit 100 may output image data R', G', and B', a first control signal CONT1, a second control signal CONT2, and a third control signal CONT3.

The image data R', G', and B' may be signals that are obtained by processing the image signals R, G, and B so as to be suitable for an operating condition of the display panel LDP. Each of the first through third control signals CONT1, CONT2, and CONT3 may include at least two or more ones of the vertical synchronization signal Vsync, the horizontal synchronization signal Hsync, the clock signal CLK, and the data enable signal DE. Each of the first through third control signals CONT1, CONT2, and CONT3 may further include signals other than these signals.

As illustrated in FIG. 2, the vertical synchronization signal Vsync defines a plurality of frame regions FR. The vertical synchronization signal Vsync includes a high period and a low period every period. A period of the vertical synchronization signal Vsync corresponds to a period of a frame region FR.

The data enable signal DE defines a blank period FPP and BPP and a display period DP, which are included in each frame region FR. For example, the data enable signal DE has a low level during the display period DP and a high level during the blank period FPP and BPP. The blank period FPP and BPP includes a first porch period FPP and a second porch period BPP. The first porch period FPP corresponds to a period from a start point of the frame region FR to a start point of the display period DP. The second porch period BPP corresponds to a period from an end point of the display period DP to an end point of the frame region FR.

Referring to FIGS. 1 and 2, the horizontal synchronization signal Hsync defines a plurality of horizontal periods of a data signal DRGB output from the data driving unit 200. A period of the horizontal synchronization signal Hsync corresponds to a period of the horizontal period. The horizontal synchronization signal Hsync includes a high period and a low period every period.

The first control signal CONT1 is provided to the data driving unit 200. The first control signal CONT1 may include the data enable signal DE, a synchronization signal Hsync indicating an input of the image data R', G', and B', a load signal directing application of a data signal DRGB corresponding to the data lines D1 through Dm, an inversion signal inverting a polarity of the data signal DRGB on a common voltage, a data clock signal, and the like. The data clock signal may be equal to the clock signal CLK received by the signal controlling unit 100.

The second control signal CONT2 is provided to the gate driving unit 300. The second control signal CONT2 may include a vertical synchronization signal Vsync indicating an output of a gate signal, a gate clock signal controlling output timing of the gate signal, an output enable signal limiting a width of the gate signal (e.g., a width of a gate on signal), and the like. The gate clock signal may be equal to the clock signal CLK received by the signal controlling unit 100.

The third control signal CONT3 may include a signal that is generated on the basis of the data enable signal DE. The third control signal CONT3 may include signals that are generated on the basis of the vertical synchronization signal Vsync, the horizontal synchronization signal Hsync, and the clock signal CLK.

As illustrated in FIG. 1, the data driving unit 200 may be connected to the data lines D1 through Dm. The data driving unit 200 may modulate a gamma reference voltage GVDD, provided from the outside, to be suitable for the image data R', G', and B', and may output the modulated result to the data lines D1 through Dm as a data signal DRGB (refer to FIG. 2).

The data driving unit 200 may output the data signal DRGB to the data lines D1 through Dm during the display period DP, based on the data enable signal DE and the horizontal synchronization signal Hsync. When the data enable signal DE has a low level, the data driving unit 200 may output the data signal DRGB in synchronization with the horizontal synchronization signal Hsync.

As illustrated in FIG. 1, the gate driving unit 300 may be connected to the gate lines G1 through Gn. The gate driving unit 300 may receive a gate driving signal and may output a gate signal to the gate lines G1 through Gn during a frame region FR. The gate driving unit 300 may include a plurality of stage circuits. The gate driving voltage may include gate-on voltages VGH1 and VGH2 and gate-off voltages VGL1 and VGL2. A polarity of the gate-on voltages VGH may be positive, and a polarity of the gate-off voltages VGL may be negative.

The gate driving unit 300 may sequentially output the gate signal to the gate lines G1 through Gn during the display period DP, based on the vertical synchronization signal Vsync and the clock signal CLK. As illustrated in FIG. 2, the gate driving unit 300 may output the gate signal after six clocks from a falling edge of the vertical synchronization signal Vsync.

Referring to FIG. 1, the gate driving voltage generating unit 400 may receive an analog driving voltage AVDD and a part of the control signal. The gate driving voltage generating unit 400 may convert the analog driving voltage AVDD into gate driving voltages VGH1, VGH2, VGL1, and VGL2 and may output the gate driving voltages VGH1, VGH2, VGL1, and VGL2 to the gate driving unit 300. The gate driving voltage generating unit 400 may output boosted gate driving voltages (hereinafter, referred to as boosting-on gate driving voltages VGH1 and VGL1) during a part (hereinafter, referred to as a boosting-on period) of the frame region, and may output non-boosted gate driving voltages (hereinafter, referred to as boosting-off gate driving voltages VGH2 and VGL2) during a remainder (hereinafter, referred to as a boosting-off period) of the frame period.

In example embodiments, the boosting-on period corresponds to the display period DP. More particularly, the gate driving voltage generating unit 400 may not output the boosting-on gate driving voltages VGH1 and VGL1 to the gate driving unit 300 when the gate driving unit 300 does not output the gate signal. At this time, the gate driving voltage generating unit 400 may output the boosting-off gate driving voltages VGH2 and VGL2. Thus, since a voltage input to the gate driving unit 300 during the blank period FPP and BPP is lower than a voltage input during the display period DP, the gate-on voltage measured at the gate driving unit 300 may be lowered by a small margin, and the gate-off voltage measured at the gate driving unit 300 may be increased by a small margin. That is, in one or more embodiments, magnitudes of the gate-on voltage and the gate-off voltage varied at the gate driving unit 300 during the blank period FPP and BPP may be less than that of a conventional display device. A resultant effect will be more fully described with reference to FIGS. 4A through 5B.

As illustrated in FIG. 3, the gate driving voltage generating unit 400 may include a boosting controlling unit 410 and a boosting unit 420. The boosting controlling unit 410 may generate a boosting unit operating signal in response to the third control signal CONT3. The boosting unit 420 may boost the analog driving voltage AVDD to generate the boosting-on gate driving voltages VGH1 and VGL1. The boosting unit 420 may output the boosting-on gate driving voltages VGH1 and VGL1 and the boosting-off gate driving voltages VGH2 and VGL2 in response to the boosting unit operating signal. The boosting unit 420 may include a booster circuit such as a charge pump. As illustrated in FIG. 3, the boosting controlling unit 410 may include an operating signal generating unit 412, a switching unit 414, and a level shifter 416. The operating signal generating unit 412 may receive the third control signal CONT3. In one or more embodiments, the third control signal CONT3 may include the data enable signal DE. The operating signal generating unit 412 may generate the boosting unit operating signal B_D by inverting a phase of the data enable signal DE.

Referring to FIG. 3, 2, the boosting unit operating signal BD may have a first period BP_1 having a high level at a low level of the data enable signal DE and a second period BP_2 and BP_3 having a low level at a high level of the data enable signal DE. In one or more embodiments, the first period BP_1 may correspond to the boosting-on period, and the second period BP_2 and BP_3 may correspond to the boosting-off period.

In one or more embodiments, the first period BP_1 may correspond to the display period DP, and the second period BP_2 and BP_3 may correspond to the blank period FPP and BPP. Thus, the second period BP_2 and BP_3 may include periods corresponding to the first porch period FPP and the second porch period BPP, respectively.

Meanwhile, the control signal CONT3 may correspond to the vertical synchronization signal Vsync and the clock signal CLK. In one or more embodiments, the operating signal generating unit 412 may generate the boosting unit operating signal B_D based on the vertical synchronization signal Vsync and the clock signal CLK. More particularly, e.g., in the exemplary embodiment of FIG. 2, the second period BP_2 and BP_3 includes periods each corresponding to the first porch period FPP and the second porch period BPP, six clock periods from a falling edge of the vertical synchronization signal Vsync are set to the second period BP_2 corresponding to the first porch period FPP, plural clock periods following the second period are set to the first period BP_1, and six clock periods following the first period BP_1 are set to the second period BP3 corresponding to the second porch period BPP.

Referring to FIG. 3, the switching unit 414 may receive the boosting unit operating signal B_D and a boosting unit enable signal B_EN. The boosting unit enable signal B_EN is a signal directing an operation of the boosting unit 420. The boosting unit enable signal B_EN may be a binary signal. For example, the switching unit 414 may output the boosting unit operating signal B_D when the boosting unit enable signal B_EN is a logical '1', and does not output the boosting unit operating signal B_D when the boosting unit enable signal B_EN is a logical '0'.

The level shifter 416 may adjust a level of the boosting unit operating signal B_D such that the first period BP_1 and the second period BP2 and BP3 of the boosting unit operating signal B_D are clearly distinguished. In one or more embodiments, the level shifter 416 may be eliminated. A boosting unit operating signal SB_D with an adjusted level may be applied to the boosting unit 420 from the boosting controlling unit 410.

The boosting unit 420 may receive the boosting unit operating signal SB_D with an adjusted level, and may boost the analog driving voltage AVDD during the first period BP_1 of the boosting unit operating signal SB_D with an adjusted level to output the boosting-on gate driving voltages VGH1 and VGL1 to the gate driving unit 300. The boosting unit 420 may output the boosting-off gate driving voltages VGH2 and VGL2 to the gate driving unit 300 without boosting the analog driving voltage AVDD during the second period BP_2 of the boosting unit operating signal SB_D to an adjusted level.

Figure 4A:
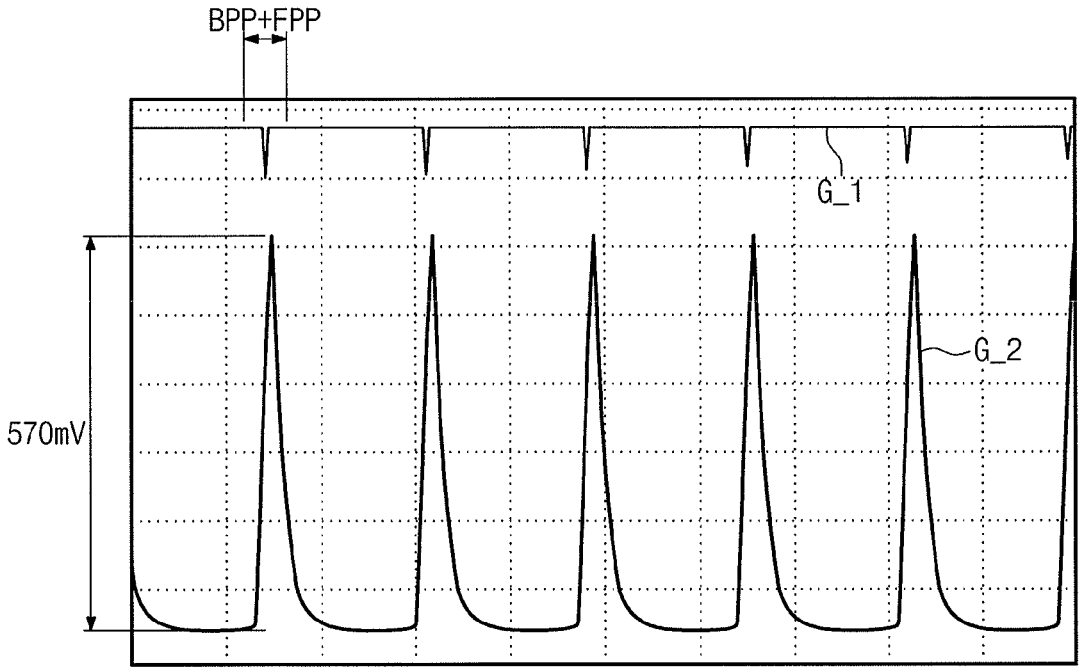
FIG. 4A illustrates a graph of a gate-on voltage measured for a conventional display device.
Figure 4B:
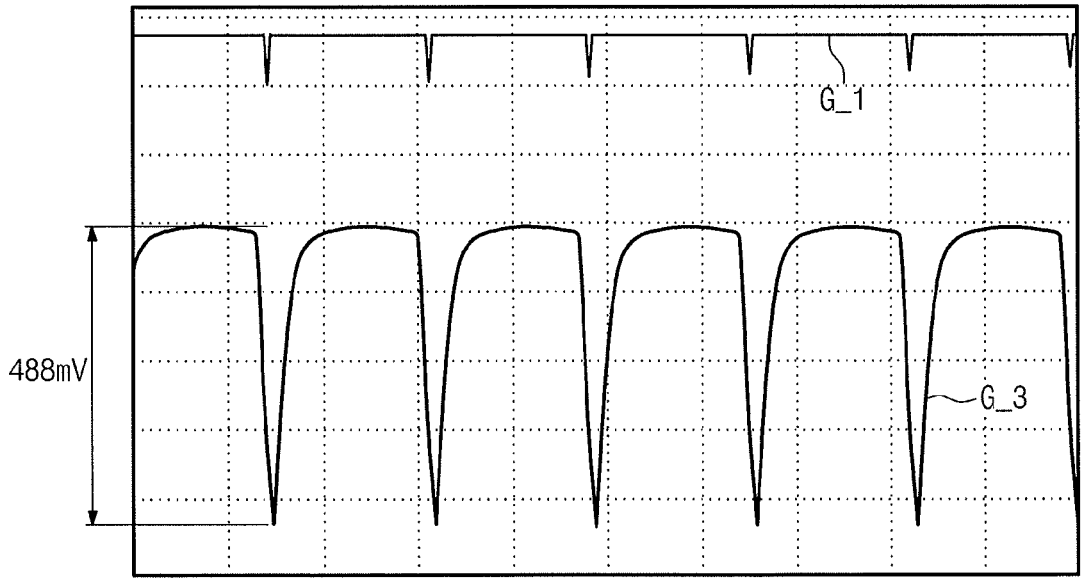
FIG. 4B illustrates a graph of a gate-off voltage measured for conventional display device.
Figure 5A:
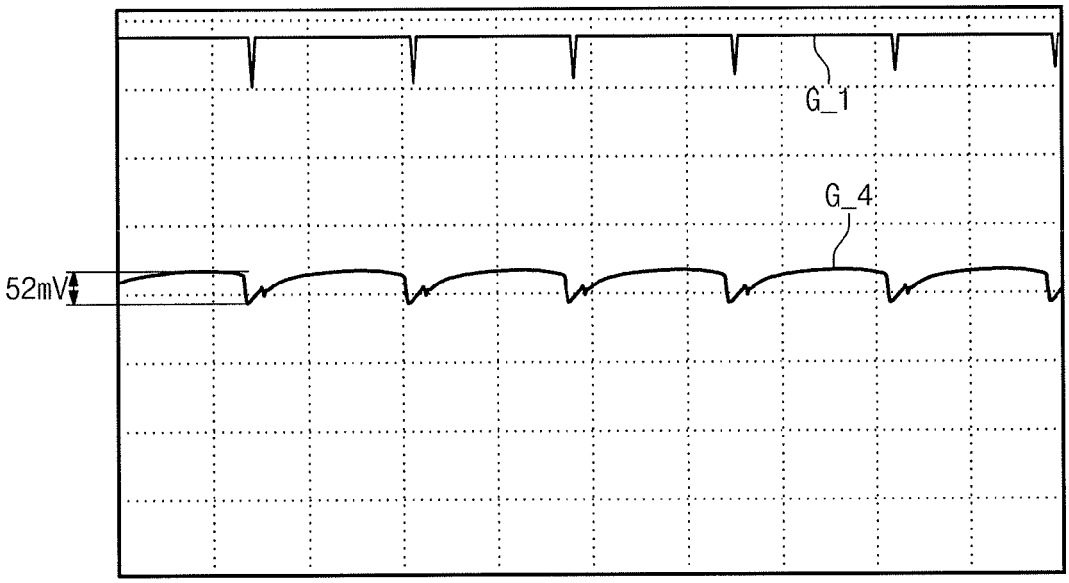
FIG. 5A illustrates a graph of a gate-on voltage measured for an exemplary embodiment of a display device.
Figure 5B:
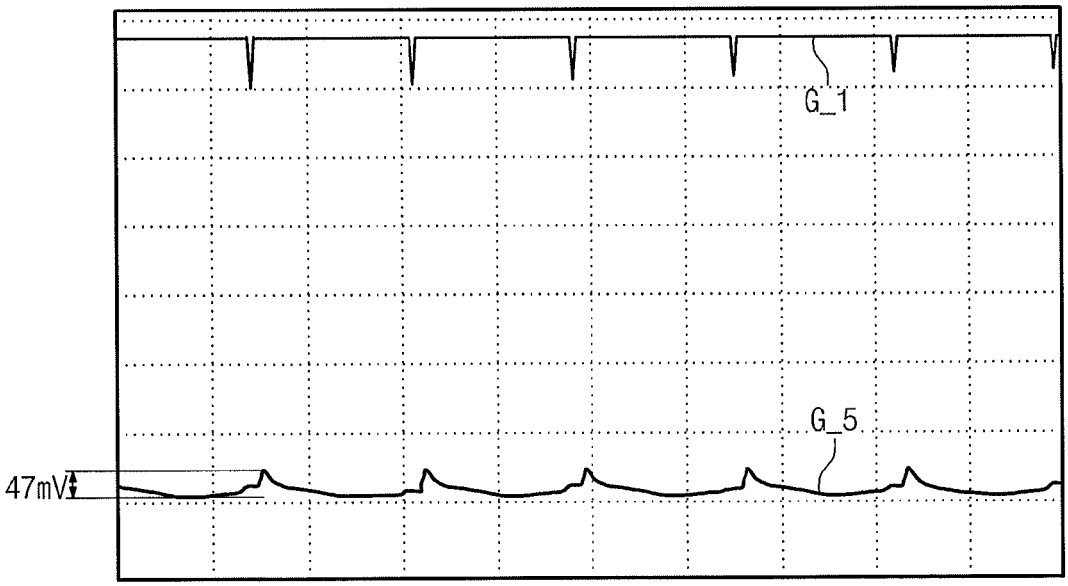
FIG. 5B illustrates a graph of a gate-off voltage measured for an exemplary embodiment of a display device.

FIG. 4A illustrates a graph of a gate-on voltage measured from a conventional display device. FIG. 4B illustrates a graph of a gate-off voltage measured from a conventional display device. FIG. 5A illustrates a graph of a gate-on voltage measured from a display device according to an exemplary embodiment. FIG. 5B illustrates a graph of a gate-off voltage measured from a display device according to an exemplary embodiment.

In FIGS. 4A through 5B, a first graph G_1 indicates a vertical synchronization signal Vsync. A second graph G_2 in FIG. 4A and a third graph G_3 in FIG. 4B indicate a gate driving voltage measured from a conventional display device. A fourth graph G_4 in FIG. 5A and a fifth graph G_5 in FIG. 5B indicate a gate driving voltage measured from a display device according to an exemplary embodiment.

The second and fourth graphs G_2 and G_4 indicate a gate-on voltage measured from a gate driving unit (e.g., the gate driving unit 300 for the fourth graph G_4). The third and fifth graphs G_3 and G_5 indicate a gate-off voltage measured from a gate driving unit (e.g., the gate driving unit 300 for the fourth graph G_4).

As understood from the second graph G_2 in FIG. 4A, a load of a gate driving unit is reduced during a blank period (BPP+FPP). On the other hand, since the gate driving unit receives a boosted gate-on voltage, the gate-on voltage measured at the gate driving unit is increased. The gate-on voltage is increased by about 570 mV as compared with a display period DP. As understood from the fourth graph G_4 in FIG. 5A, since the gate driving unit 300 receives the gate-on voltage that is not boosted, the gate-on voltage measured from the gate driving unit 300 is lowered. The gate-on voltage is lowered by about 52 mV as compared with the display period DP.

Referring to FIGS. 4A and 5A, in comparison to conventional devices (FIG. 4A) in embodiments of a display device according to an embodiment of the inventive concept (FIG. 5A), a fluctuation width of the gate-on voltage VGH during the blank period FPP and BPP may be less than that of a conventional display device. Thus, in one or more embodiments, the gate-on voltage VGH may have a constant level within a short time as compared with the conventional display device, upon switching to the display period DP from the blank period (BPP+FPP). As a result, the display device according to one or more embodiments including one or more features described herein may reduce fluctuation and ripple of a gate signal.

As understood from the third graph G_3 in FIG. 4B, a load of the convention gate driving unit may be reduced during the blank period (BPP+FPP). On the other hand, since the gate driving unit 300 according to one or more embodiments may receive a boosted gate-on voltage, the gate-off voltage measured at the gate driving unit 300 may be lowered. The gate-off voltage may be lowered by about 488 mV as compared with the display period DP. As understood from the fifth graph G_5 in FIG. 5B, since the gate driving unit 300 receives the gate-on voltage that is not boosted, the gate-off voltage measured at the gate driving unit 300 may be increased. The gate-off voltage may be increased by about 47 mV as compared with the display period DP.

Referring to FIGS. 4B and 5B, in case of the display device according to an embodiment of the inventive concept (FIG. 5B), a fluctuation width of the gate-off voltage during the blank period FPP and BPP is less than that of the conventional display device (FIG. 4B). Thus, in case of the display device according to an embodiment of the inventive concept (FIG. 5B), the gate-off voltage VGL has a constant level within a short time as compared with the conventional display device (FIG. 4B), upon switching to the display period DP from the blank period (BPP+FPP).

Referring to FIGS. 4A through 5B, and, more particularly, referring to FIGS. 5A and 5B, one or more embodiments of a display device employing one or more features described herein may be configured such that a fluctuation width of a gate driving voltage applied to the gate driving unit 300 during the blank period (BPP+FPP) becomes small as compared with the conventional display device. A flicker difference of the display device may be reduced as illustrated in the following table.

TABLE 1

| | Flicker value (dB) | | |
|---|---|---|---|
| | Upper | Intermediate | Lower |
| Conventional | 22.5 | 15.1 | 15 |
| Exemplary Embodiments | 8.2 | 7.1 | 7.3 |

In Table 1, a flicker value is measured at upper, intermediate, and lower portions of a display panel, respectively. Herein, the upper portion may be located at a point corresponding to a first gate line G1 of a display panel LDP. The lower portion may be located at a point corresponding to an nth gate line Gn of the display panel LDP. The intermediate portion may be located at a point corresponding to a gate line which is located at a center between the first gate line G1 and the nth gate line Gn of the display panel LDP.

As illustrated in the table 1, since a width of a voltage variation for the blank period (BPP+FPP) is narrow, one or more embodiments of a display device employing one or more features described herein may reduce a flicker difference according to a location of the display panel LDP as compared with the conventional display device. Thus, an image quality of one or more embodiments of a display device employing one or more features described herein may be improved.

Figure 6:
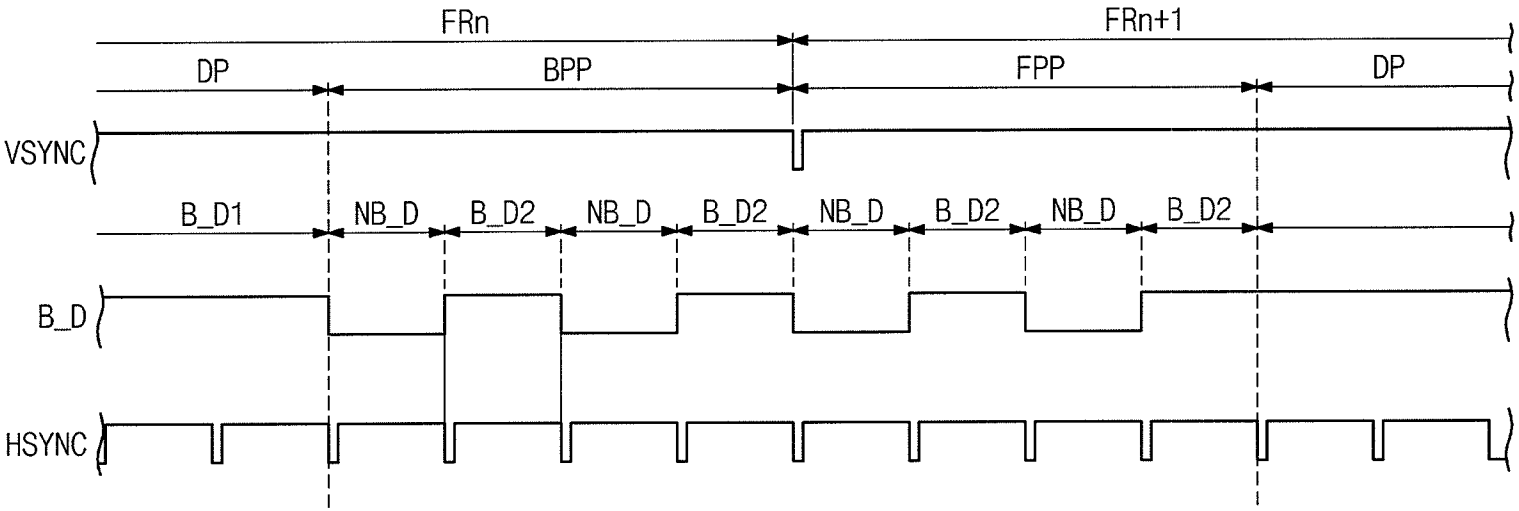
FIG. 6 illustrates a timing diagram of exemplary signals according to another exemplary embodiment.
Figure 7:
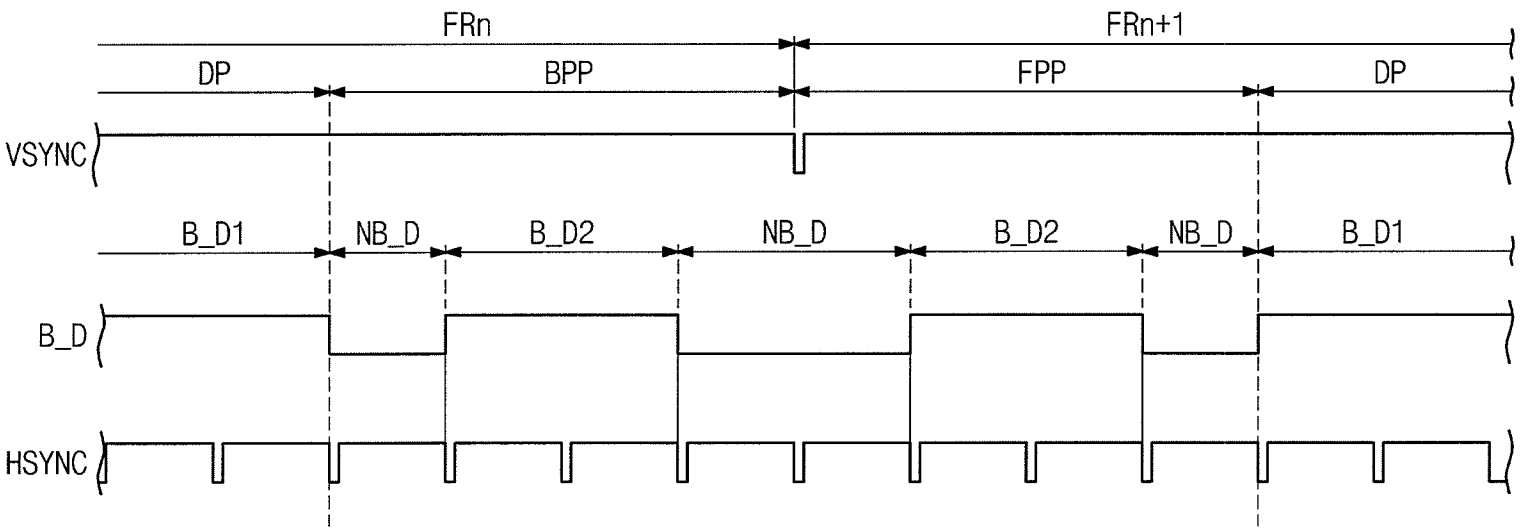
FIG. 7 illustrates a timing diagram of exemplary signals according to another exemplary embodiment.

FIG. 6 illustrates a timing diagram of exemplary signals according to another embodiment. FIG. 7 illustrates a timing diagram of exemplary signals according to another embodiment. A display device according to other exemplary embodiments of the inventive concept will be described with reference to FIGS. 6 and 7. Constituent elements that are identical to those described in relation to FIGS. 1 through 5 are marked by the same reference numerals, and description thereof is not repeated.

In one or more embodiments, the display device, as illustrated in FIG. 1, may include the display panel LDP, the signal controlling unit 100, the data driving unit 200, the gate driving unit 300, and the gate driving voltage generating unit 400.

In one or more embodiments, the gate driving voltage generating unit 400 may provide boosting-on gate driving voltages VGH1 and VGL1 to the gate driving unit 300 during a period corresponding to a display period DP and also during a period corresponding to a part of a blank period FPP and BPP. The display period DP and the period corresponding to a part of the blank period FPP and BPP may be defined as a boosting-on period, and a period corresponding to a remainder of the blank period FPP and BPP may be defined as a boosting-off period.

The gate driving voltage generating unit 400 (refer to FIG. 3) may include a boosting controlling unit 410 and a boosting unit 420. A third control signal CONT3 may include a vertical synchronization signal Vsync, a horizontal synchronization signal Hsync, and a clock signal CLK. An operating signal generating unit 412 generates a boosting unit operating signal BD based on the vertical synchronization signal Vsync, the horizontal synchronization signal Hsync, and the clock signal CLK. The boosting unit operating signal B_D has a high level during a first driving period B_D1 corresponding to the display period DP and during a second driving period B_D2 corresponding to a part of the blank period FPP and BPP. On the other hand, the boosting unit operating signal BD has a low level during a non-driving period NB_D corresponding to the remaining of the blank period FPP and BPP. The operating signal generating unit 412 establishes the first driving period B_D1 of the boosting unit operating signal B_D and a period other than the first driving period B_D1, based on the vertical synchronization signal Vsync and the clock signal CLK. The period other than the first driving period B_D1 may correspond to the blank period FPP and BPP.

The operating signal generating unit 412 establishes the second driving period B_D2 of the boosting unit operating signal B_D corresponding to a part of the blank period FPP and BPP, based on the horizontal synchronization signal. Thus, the non-driving period NB_D of the boosting unit operating signal B_D is set to correspond to the remaining of the blank period FPP and BPP. The boosting unit operating signal B_D may include the second driving period B_D2 and the non-driving period NB_D respectively corresponding to a first porch period FPP and a second porch period BPP.

As illustrated in FIG. 6, the second driving period B_D2 and the non-driving period NB_D of the boosting unit operating signal B_D may alternate during the blank period FPP and BPP in relation to the horizontal synchronization signal Hsync. One period of the horizontal synchronization signal Hsync is set to the second driving period B_D2, and a next period thereof is set to the non-driving period NB_D. At this time, a length of the second driving period B_D2 may be completely and/or substantially equal to that of the non-driving period NB_D.

The boosting unit 420 may receive the boosting unit operating signal B_D, and outputs boosting-on gate driving voltages VGH1 and VGL1 to the gate driving unit 300 at the first driving period B_D1 and the second driving period B_D2. The boosting unit 420 may output boosting-off gate driving voltages VGH2 and VGL2 to the gate driving unit 300 during the non-driving period NB_D.

As illustrated in FIG. 7, the second driving period B_D2 of the boosting unit operating signal B_D may have a length corresponding to a plurality of periods of the horizontal synchronization signal Hsync of the blank period FPP and BPP. For example, the second driving period B_D2 of the boosting unit operating signal B_D may have a length corresponding to two periods of the horizontal synchronization signal Hsync. As illustrated in FIG. 7, the second porch period BPP may have a length corresponding to four periods of the horizontal synchronization signal Hsync. In such embodiments, the boosting unit operating signal B_D may have a falling edge at a falling edge of a second period of the four periods of the horizontal synchronization signal Hsync, and may have a rising edge at a falling edge at the second period thereof. During the blank period FPP and BPP, the second driving period B_D2 and the non-driving period NB_D of the boosting unit operating signal B_D may not alternate in relation to the horizontal synchronization signal Hsync.

One or more embodiments of a display device employing one or more features described herein may provide the boosting-on gate driving voltages VGH1 and VGL1 to the gate driving unit 300 during a part of the blank period FPP and BPP. The boosting unit 420 may output the boosting-on gate driving voltages VGH1 and VGL1 in response to the boosting unit operating signal B_D illustrated in FIGS. 6 and 7. Accordingly, in one or more embodiments, during the blank period FPP and BPP, it is possible to prevent the gate-on voltage from being lowered excessively and the gate-off voltage from being increased excessively. That is, in one or more embodiments, it is possible to reduce a variation level of a gate driving voltage applied to the gate driving unit 300 during the blank period FPP and BPP.

In one or more embodiments, a boosted gate driving voltage may be supplied to a gate driving unit during a display period, and a gate driving voltage that is not boosted is supplied to the gate driving unit during a blank period. One or more embodiments make it possible to reduce a variation level of a gate driving voltage applied to the gate driving unit during the blank period. One or more embodiments may reduce fluctuation and ripple of the gate signal, and may improve image quality of the display device.

In one or more other embodiments, a boosted gate driving voltage may be further supplied to a gate driving unit during a period of a blank period. In such embodiments, during the blank period, it is possible to prevent the gate-on voltage from being lowered excessively and the gate-off voltage from being increased excessively. Accordingly, in one or more such embodiments, a variation level of the gate driving voltage applied to the gate driving unit during the blank period may be reduced.

Further, in one or more embodiments, as a gate driving voltage generating unit may operate as needed, power consumption of the display device may be reduced.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description.

What is claimed is:

1. A display device, comprising:

a signal controlling unit to output a plurality of control signals and image data based on a vertical synchronization signal defining a frame period including a blank period and a display period, a horizontal synchronization signal, a clock signal, and a data enable signal;

a data driving unit to receive the image data and to output a data signal converted from the image data during the display period;

a gate driving voltage generating unit to receive a part of the control signals and an analog driving voltage, the gate driving voltage generating unit to output a boosting-on gate driving voltage, generated based on the analog driving voltage, during a boosting-on period corresponding to a part of the frame period and a boosting-off gate driving voltage, generated based on the analog driving voltage, during a boosting-off period corresponding to a remainder of the frame period;

a gate driving unit to output a gate signal during the display period in response to the boosting-on gate driving voltage; and a display panel to display an image in response to the gate signal and the data signal.

2. The display device as claimed in claim 1, wherein the gate driving voltage generating unit comprises:

a boosting controlling unit to generate a boosting unit operating signal in response to the part of the control signals; and a boosting unit to receive the analog driving voltage and to output the boosting-on gate driving voltage and the boosting-off gate driving voltage in response to the boosting unit operating signal.

3. The display device as claimed in claim 2, wherein the boosting unit operating signal has a first level during the boosting-on period and a second level different from the first level during the boosting-off period, and the boosting unit is to output the boosting-on gate driving voltage and the boosting-off gate driving voltage according to a level of the boosting unit operating signal.

4. The display device as claimed in claim 3, wherein the boosting-on period corresponds to the display period.

5. The display device as claimed in claim 4, wherein the part of the control signals is generated according to the data enable signal, the data enable signal defines the blank period and the display period, and the boosting controlling unit is to invert a phase of the data enable signal and to generate the boosting unit operating signal having the first level and the second level.

6. The display device as claimed in claim 3, wherein the boosting-on period includes the display period and a part of the blank period.

7. The display device as claimed in claim 6, wherein the part of the control signals is generated according to the vertical synchronization signal, the horizontal synchronization signal, and the clock signal, and the boosting controlling unit decides a first driving period of the boosting unit operating signal, having the first level, corresponding to the display period based on the vertical synchronization signal and the clock signal and a second driving period of the boosting unit operating signal, having the first level, corresponding to the part of the blank period based on the horizontal synchronization signal.

8. The display device as claimed in claim 7, wherein the blank period comprises a first porch period corresponding to a period from a start point of the frame period to a start point of the display period, and a second porch period corresponding to a period from an end point of the display period to an end point of the frame period.

9. The display device as claimed in claim 7, wherein the boosting unit operating signal includes the second driving period having the first level and a non-driving period having the second level corresponding to the blank period, and the second driving period and the non-driving period are alternated during the blank period.

10. The display device as claimed in claim 7, wherein the boosting unit operating signal includes the second driving period having the first level and a non-driving period having the second level corresponding to the blank period, and the second driving period has a length corresponding to plural periods of the horizontal synchronization signal.

11. The display device as claimed in claim 1, wherein the boosting-on period corresponds to the display period.

12. The display device as claimed in claim 11, wherein the blank period comprises a first porch period corresponding to a period from a start point of the frame period to a start point of the display period; and a second porch period corresponding to a period from an end point of the display period to an end point of the frame period.

13. The display device as claimed in claim 1, wherein the boosting-on period includes a first driving period corresponding to the display period and a second driving period corresponding to a part of the blank period.

14. The display device as claimed in claim 13, wherein the blank period comprises a first porch period corresponding to a period from a start point of the frame period to a start point of the display period; and a second porch period corresponding to a period from an end point of the display period to an end point of the frame period.

15. The display device as claimed in claim 14, wherein the first porch period and the second porch period include the second driving period, respectively.

16. The display device as claimed in claim 13, wherein the blank period includes the second driving period and a non-driving period, and the second driving period and the non-driving period of the blank period alternate.

17. The display device as claimed in claim 16, wherein a length of the second driving period is substantially or completely equal to a length of the non-driving period.

18. The display device as claimed in claim 1, wherein the display panel comprises:

a plurality of data lines;

a plurality of gate lines isolated from the plurality of data lines and arranged to intersect with the plurality of data lines; and a plurality of pixels arranged at intersections of the plurality of data lines and the plurality of gate lines, respectively.

19. The display device as claimed in claim 18, wherein each of the plurality of pixels comprises:

a switching element to output the data signal in response to the gate signal; and a liquid crystal capacitor to receive the data signal and a common voltage having a voltage level different from the data signal.

20. The display device as claimed in claim 1, wherein:

the boosting-on gate driving voltage includes a first gate-on voltage and a first gate-off voltage, the first gate-on voltage is positive, and the first gate-off voltage is negative, and the boosting-off gate driving voltage includes a second gate-on voltage and a second gate-off voltage, the second gate-on voltage is positive, and the second gate-off voltage is negative.

21. The display device as claimed in claim 1, wherein:

the boosting-on gate driving voltage includes a first gate-on voltage and a first gate-off voltage, and the boosting-off gate driving voltage includes a second gate-on voltage and a second gate-off voltage, wherein:

the first gate-on voltage is higher than the second gate-on voltage, and the first gate-off voltage is lower than the second gate-off voltage.

22. The display device as claimed in claim 1, wherein:

the boosting-on gate driving voltage includes a first gate-on voltage and a first gate-off voltage, and the first gate-on voltage and the first gate-off voltage are transferred to the gate driving unit through respective lines and the boosting-off gate driving voltage includes a second gate-on voltage and a second gate-off voltage, and the second gate-on voltage and the second gate-off voltage are transferred to the gate driving unit through the respective lines.

23. A display device, comprising:

a signal controlling unit to output image data;

a gate driving unit to output a gate signal during a display period of a frame period including the display period and a blank period;

a data driving unit to convert the image data into a data signal and to output the data signal during the display period;

a gate driving voltage generating unit to receive an analog driving voltage and to output a boosting-on gate driving voltage, generated based on the analog driving voltage, to the gate driving unit during a boosting-on period corresponding to a part of the frame period and a boosting-off gate driving voltage, generated based on the analog driving voltage, to the gate driving unit during a boosting-off period corresponding to a remainder of the frame period; and a display panel to display an image in response to the gate signal and the data signal.

* * * * *